US006068545A

United States Patent [19]

Arai

[11] Patent Number: 6,068,545

[45] Date of Patent: May 30, 2000

[54] WORKPIECE SURFACE PROCESSING APPARATUS

[75] Inventor: Hatsuyuki Arai, Ayase, Japan

[73] Assignee: Speedfam Co., Ltd., Japan

[21] Appl. No.: 09/235,099

[22] Filed: Jan. 21, 1999

[30] Foreign Application Priority Data

Mar. 10, 1998 [JP] Japan ..... 10-076551

[51] Int. Cl.[7] ..... B24B 5/00; B24B 29/00

[52] U.S. Cl. ..... 451/288; 451/287; 451/272

[58] Field of Search ..... 451/41, 42, 57, 451/58, 63, 65, 270, 272, 273, 274, 285, 287, 288, 392, 393, 394, 396, 397, 398

[56] References Cited

U.S. PATENT DOCUMENTS

| | | | |
|---|---|---|---|
| 5,384,986 | 1/1995 | Hirose et al. | 451/394 |
| 5,435,772 | 7/1995 | Yu | 451/41 |
| 5,674,109 | 10/1997 | Kanzawa et al. | 451/41 |
| 5,791,969 | 8/1998 | Lund | 451/63 |
| 5,800,253 | 9/1998 | Ikemoto | 451/63 |
| 5,868,605 | 2/1999 | Cesna | 451/41 |

FOREIGN PATENT DOCUMENTS

| | | |
|---|---|---|
| 64-11757 | 1/1989 | Japan . |
| 3-221368 | 9/1991 | Japan . |

*Primary Examiner*—Derris Holt Banks
*Attorney, Agent, or Firm*—Wall Marjama Bilinski & Burr

[57] ABSTRACT

A workpiece surface processing apparatus capable of processing the surface of a workpiece without being limited as to the shape of the workpiece and further capable of measuring the state of polish of the workpiece with a high precision. The workpiece surface processing apparatus includes three platens 1-1 to 1-3 arranged substantially point symmetrically and being rotated in the same direction by motors 17 to 19, a carrier head 2 holding a wafer W and rotating in an opposite direction to the platens 1-1 to 1-3, a rocking mechanism 3 for making the wafer W rock in a diametrical direction of the platen 1-1 so that the entire surface of the wafer W is polished. A measuring device 4 continuously measures the state of polish of the entire surface of the wafer W.

5 Claims, 9 Drawing Sheets

WORKPIECE SURFACE PROCESSING APPARATUS

BACKGROUND OF THE INVENTION

1. Field of the Invention

The present invention relates to a workpiece surface processing apparatus capable of processing the surface of a workpiece by a plurality of platens and capable of measuring the state of processing of the workpiece.

2. Description of the Related Art

In the past, as an apparatus for processing the surface of a workpiece by a plurality of platens, there has for example been the polishing apparatus such as shown in FIG. 11.

In FIG. 11, reference numeral 100 indicates a platen. Three platens 100 are arranged point symmetrically about a point O. Three holders 101 are provided between these three platens 100.

Due to this, by pressing against and making a donut-shaped wafer W rotate by the three rotating platens 100, the wafer W is polished to a predetermined thickness.

To polish an oxide film of the wafer W to a predetermined thickness by the polishing apparatus, however, it is necessary to monitor the state of polish of the wafer W.

Therefore, in the past, as shown in FIG. 12, a window 201 of a suitable size was made at a predetermined location of a platen 200 and a laser beam was emitted from a laser sensor 210 arranged under the platen 200 through the window 201 to the polished surface of the wafer W to detect the state of polish of the wafer W.

Further, as shown by the two-dot chain line, there is also a technique of arranging the laser sensor 210 down and out from the platen 200 and emit the laser beam to an overhanging projecting portion of the wafer W to detect the state of polish of the wafer W.

With the above related art, however, there were the following problems.

In the polishing apparatus shown in FIG. 11, the wafer W is polished by the rotating platens 100 in a state with the outer peripheral rim of the wafer W held by the holders 101, so it was only possible to polish a wafer W of a donut shape.

That is, when using a disk-shaped wafer W, as shown by the hatching in FIG. 11, since it is not possible to polish the center portion of the wafer W corresponding to the circular region G among the three platens 100, the polishable wafer W ends up being limited to one of a donut shape having a center hole of a size greater than this region G.

As art related to the above polishing apparatus, there are the grinding machine described in Japanese Patent Laid-Open No. 64-11757 and the wafer processing apparatus described in Japanese Patent Laid-Open No. 3-221368, but these apparatuses do not solve the above problem either.

Further, in the technique for measuring the state of polish of the wafer shown in FIG. 12, it is possible to measure the state of polish of the wafer W by the laser beam 210 only when the window 201 of the rotating platen 200 is directly above the laser sensor 210 and the wafer W covers the window 201. Therefore, measurement becomes intermittent and it is difficult to stop the polishing apparatus just when the oxide film of the wafer W has been polished to the optimal thickness. As a result, situations such as excessive polishing or insufficient polishing of the wafer W easily occur. Further, since it is not possible to judge if the portion of the wafer W at the window 201 is a center portion or peripheral portion of the wafer W, it is not possible to measure the state of polish with a high precision.

As opposed to this, in the technique for making the wafer W overhang and measuring the projecting portion by the laser sensor 210, it is possible to judge whether the currently measured location is the peripheral portion or not. Since, however, the amount of overhang is set to be considerably smaller than the radius of the wafer W, it is not possible to measure the center portion of the wafer W. Further, since measurement is possible only when the wafer W is overhanging, this technique also allows only intermittent measurement and therefore like the above art there is the possibility of situations such as excessive polishing or insufficient polishing occurring.

SUMMARY OF THE INVENTION

The present invention was made so as to solve the above problems and has as its object to provide a workpiece surface processing apparatus which enables the surface of a workpiece to be processed without limitation as to the shape of the workpiece and which enables high precision measurement of the state of polish of the workpiece.

To achieve this object, according to the present invention, there is provided a workpiece surface processing apparatus comprising: a plurality of platens arranged substantially point symmetrically and capable of rotating about their centers; a pressing member for making a workpiece contact the plurality of platens and making the workpiece rotate while being pressed; and a position changing mechanism for making the pressing member shift position in a rectilinear direction eliminating the portion of the workpiece not contacting the plurality of platens.

Due to this configuration, when the plurality of point symmetrically arranged platens are made to rotate and the workpiece is made to contact these platens and to rotate while being pressed by the pressing member, the surface of the workpiece contacted is processed by the plurality of rotating platens. At this time, the portion of the workpiece not contacting the platens is not processed by the platens, so the position changing mechanism is operated to make the workpiece shift position in the direction eliminating the portion of the workpiece not contacting them and enable uniform processing of the entire surface of the workpiece.

In the workpiece surface processing apparatus of the present invention, preferably the pressing member is one which makes the workpiece contact the plurality of platens so that the center of the workpiece substantially matches with the center of the plurality of platens, and the position changing mechanism makes the pressing member shift position so that the workpiece moves in a diametrical direction of one platen by exactly a distance of about the radius of the inside inscribed circle of the plurality of platens.

Due to this configuration, the workpiece contacts the plurality of platens stably and by just making the workpiece move by the shifting mechanism by exactly the distance of about the radius of the inside inscribed circle of the plurality of platens, it is possible to uniformly process the surface of the workpiece as a whole.

Note that while it is sufficient that a plurality of platens be provided, it is preferable to select the optimal number of platens from the viewpoints of the cost, the stability of the workpiece, etc.

In the workpiece surface processing apparatus of the present invention and its preferred embodiment, therefore, preferably three platens are provided.

Further, this workpiece surface polishing apparatus can be used for diverse applications such as grinding in addition to polishing a workpiece. Therefore, in the workpiece surface processing apparatus of the present invention and its preferred embodiments, the platens are preferably grinding platens, lapping platens, or polishing platens.

Further, the workpiece which is processed is not particularly limited. Various types of workpieces may be processed over their entire surfaces.

In the workpiece surface processing apparatus of the present invention and its preferred embodiments, the workpiece is preferably a wafer.

If it were possible to measure the state of processing of the surface of the workpiece during processing, then it would possible to reliably process the workpiece to the desired amount of processing and possible to process it at a high precision.

In the workpiece surface processing apparatus of the present invention and its preferred embodiments, preferably further provision is made of a measuring device for making a light beam scan the processed surface of the workpiece from at least the center to the peripheral rim and measuring the state of processing of the processed surface as a whole.

Due to this configuration, since the light beam from the measuring device scans from at least the center to the peripheral rim of the processed surface of the rotating workpiece, it is possible to continuously measure the processed surface as a whole.

BRIEF DESCRIPTION OF THE DRAWINGS

The above and other objects, features, and advantages of the present invention will become more readily apparent from the following description of presently preferred embodiments of the invention taken in conjunction with the accompanying drawings, in which.

DESCRIPTION OF THE PREFERRED EMBODIMENTS

Preferred embodiments of the present invention will be explained below with reference to the drawings.

Figure 1:
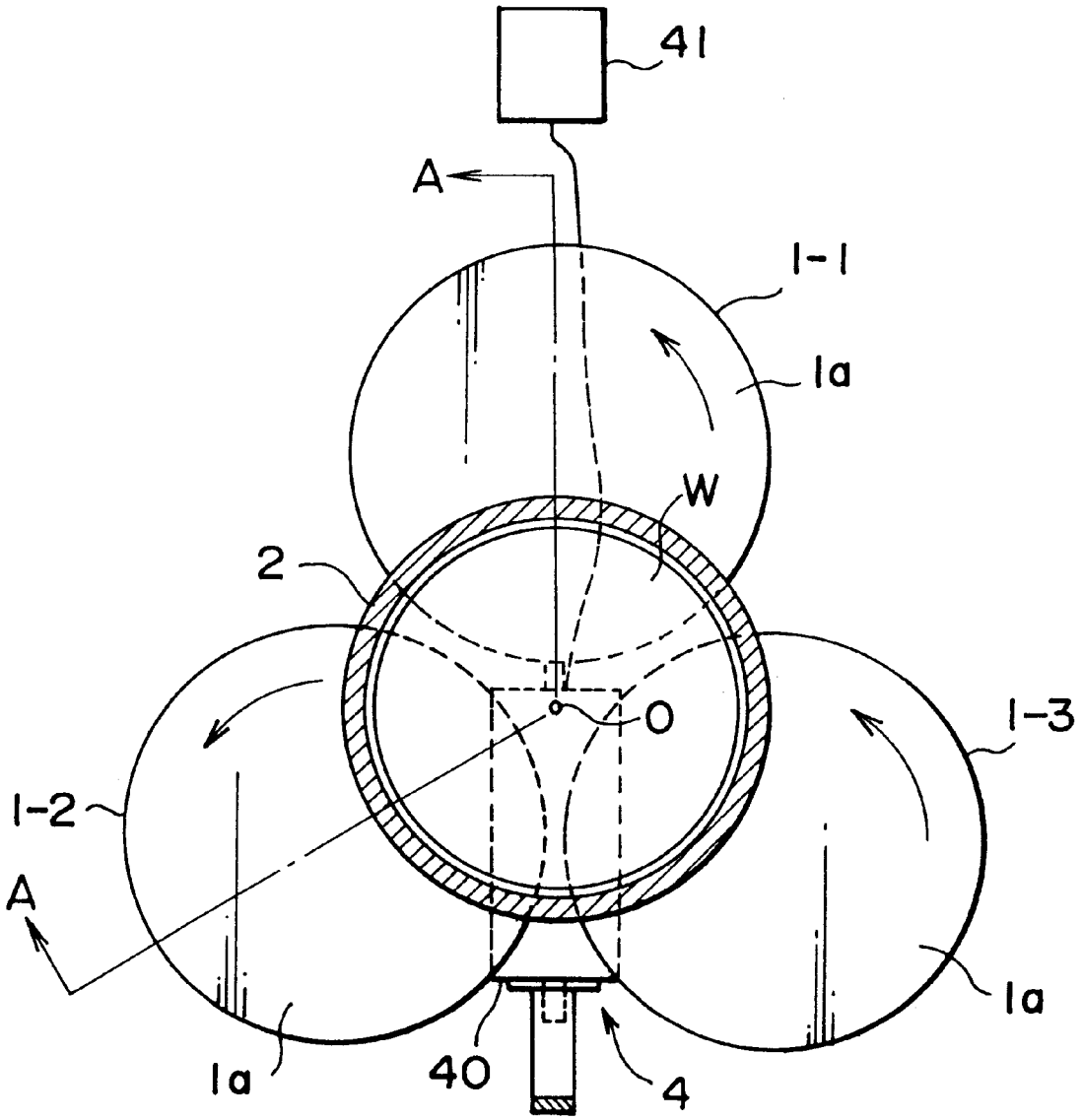
FIG. 1 is a plan view of a wafer surface polishing apparatus according to a first embodiment of the present invention.
Figure 2:
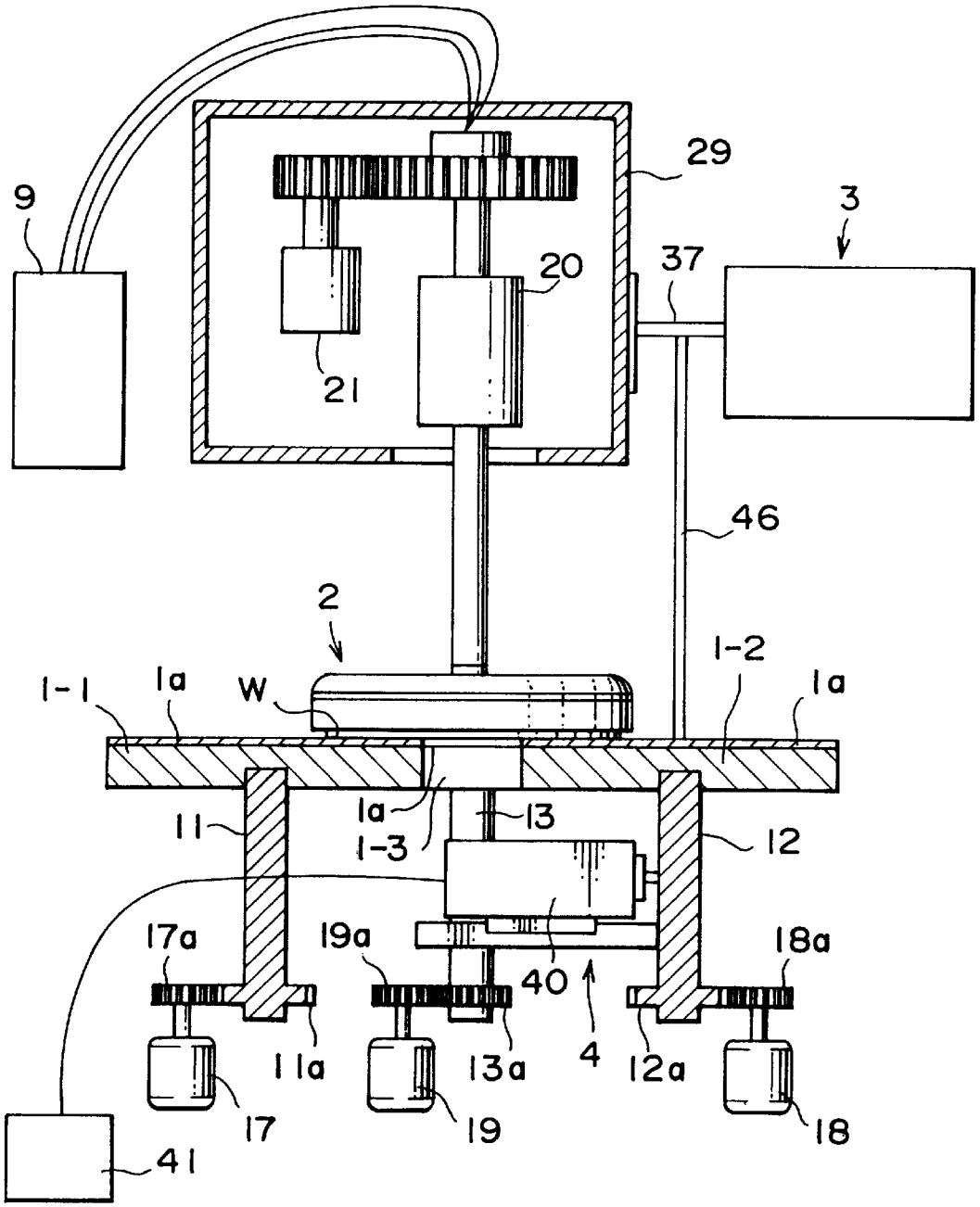
FIG. 2 is a sectional view taken along the line A—A of FIG. 1.

FIG. 1 is a plan view of a wafer surface polishing apparatus according to a first embodiment of the present invention; while FIG. 2 is a sectional view taking along the line A—A of FIG. 1.

This wafer surface polishing apparatus is a CMP apparatus which is provided with three platens 1-1 to 1-3, a carrier head 2 serving as a pressing member, a position changing mechanism 3, and a measuring device 4 (see FIG. 2).

The platens 1-1 to 1-3 are disks for polishing an oxide film of the wafer W, and as shown in FIG. 1, they are arranged substantially point symmetrically with respect to a center point O of the platens 1-1 to 1-3.

Further, the platens 1-1 to 1-3 are polishing platens, and as shown in FIG. 2, a polishing pad 1*a* is adhered to the top of the platen 1-1 (1-2 and 1-3).

Shafts 11 to 13 are affixed to the centers of the bottom surfaces of the platens 1-1 to 1-3. The platens 1-1 to 1-3 are rotatably supported by not shown bearings.

Gears 11*a* to 13*a* are affixed to the bottom ends of the shafts 11 to 13 of the platens 1-1 to 1-3. These gears 11*a* to 13*a* are engaged with the gears 17*a* to 19*a* affixed to the shafts of the motors 17 to 19.

Due to this, the platens 1-1 to 1-3 are driven to rotate by the operation of the motors 17 to 19.

The carrier head 2 is a device for making the wafer W contact the platens 1-1 to 1-3 and making the wafer W rotate while being pressed against. The carrier head 2 is assembled in a support 29 together with a cylinder 20 for raising and lowering the carrier head 2 and a motor 21 for making the carrier head 2 rotate.

Figure 3:
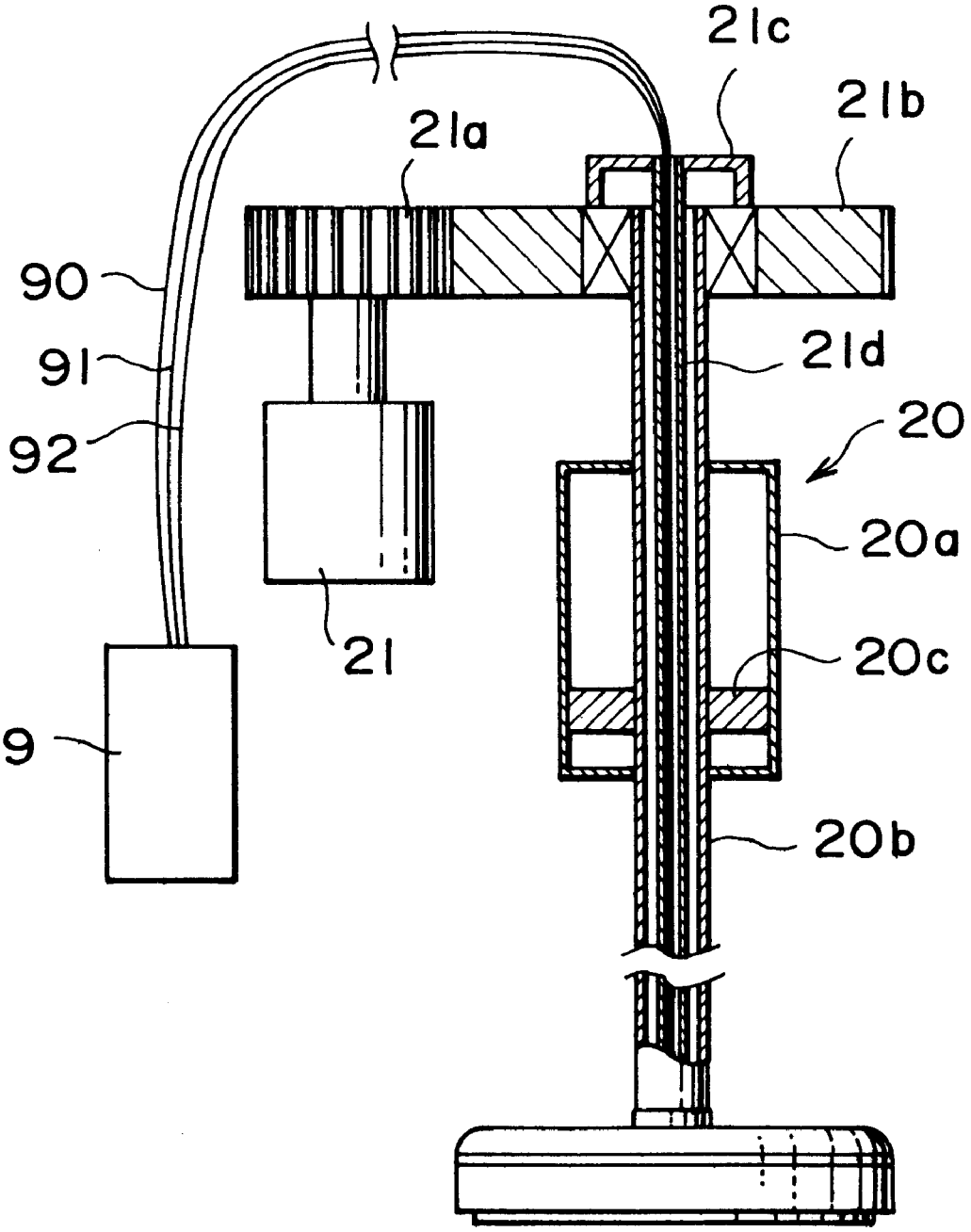
FIG. 3 is a sectional view of the mechanism of the cylinder and motor.

FIG. 3 is a sectional view of the mechanism of the cylinder 20 and motor 21.

As shown in FIG. 3, the cylinder 20 is formed by a cylinder body 20*a* affixed to the support 29 (see FIG. 2), a piston rod 20*b* passing through the cylinder body 20*a*, and a piston 20*c* fit in the cylinder body 20*a*. The motor 21 is connected to the piston rod 21. That is, a gear 21*a* of the motor 21 is engaged with a gear 21*b* attached to the top of the piston 20*c* through a bearing, while an inner rod 21*d* is connected to a support member 21*c* affixed to the gear 21*b*.

Due to this, it is possible to raise or lower the carrier head 2 by changing the air pressure in the cylinder body 20*a* of the cylinder 20 and to make the carrier head 2 rotate by operating the motor 21.

This carrier head 2 having a cylinder 20 and motor 21 is structured to be able to change the distribution of the force pressing against the wafer W.

Figure 4:
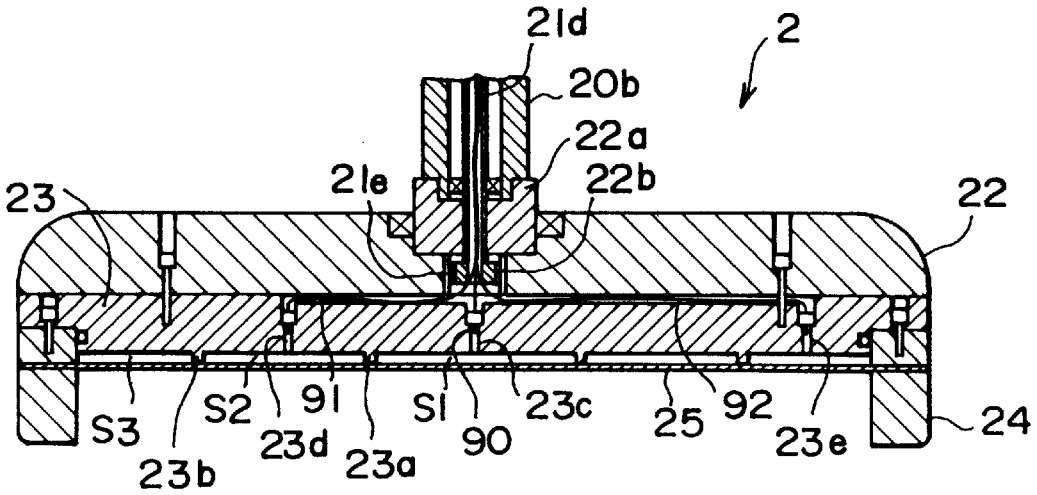
FIG. 4 is a sectional view of a carrier head.

FIG. 4 is a sectional view of a carrier head 2.

As shown in FIG. 4, the carrier head 2 is provided with a housing 22, a carrier base 23, a retainer ring 24, and a backing sheet 25.

The housing 22 is connected through a rotatable connecting member 22*a* to a piston rod 20*b*. An internal gear 22*a* of the housing 22 is engaged with the gear 21*e* at the bottom end of the inner rod 21*d*. Further, the carrier base 23 has two concentric ring-shaped partitions 23*a* and 23*b* at its bottom surface. A backing sheet 25 supported by the retainer ring 24 is adhered to the ring-shaped partitions 23*a* and 23*b*.

That is, pressure chambers S1, S2, and S3 are defined by the ring-shaped partitions 23*a* and 23*b*. Flow paths 23*c*, 23*d*, and 23*e* communicating with these pressure chambers S1, S2, and S3 respectively are provided in the carrier base 23. Further, air hoses 90, 91, and 92 passing through the inner rod 21*d* are inserted into these flow paths 23*c*, 23*d*, and 23*e*, respectively. The air hoses 90, 91, and 92 extend from an air pump 9 as shown in FIG. 2 and FIG. 3. By changing the pressure of the air supplied to the air hoses 90, 91, and 92, it is possible to adjust the pressure inside the pressure chambers S1, S2, and S3.

Note that the carrier head 2 is designed to make the wafer W contact the platens 1-1 to 1-3 so that in the initial state free from the action of the position changing mechanism 3, the center of the wafer W substantially matches with the center point O of the platens 1-1 to 1-3 shown in FIG. 1.

The position changing mechanism 3 is a mechanism for making the carrier head 2 in a shift rectilinear direction eliminating the portion of the wafer W not contacting the platens 1-1 to 1-3.

Figure 5:
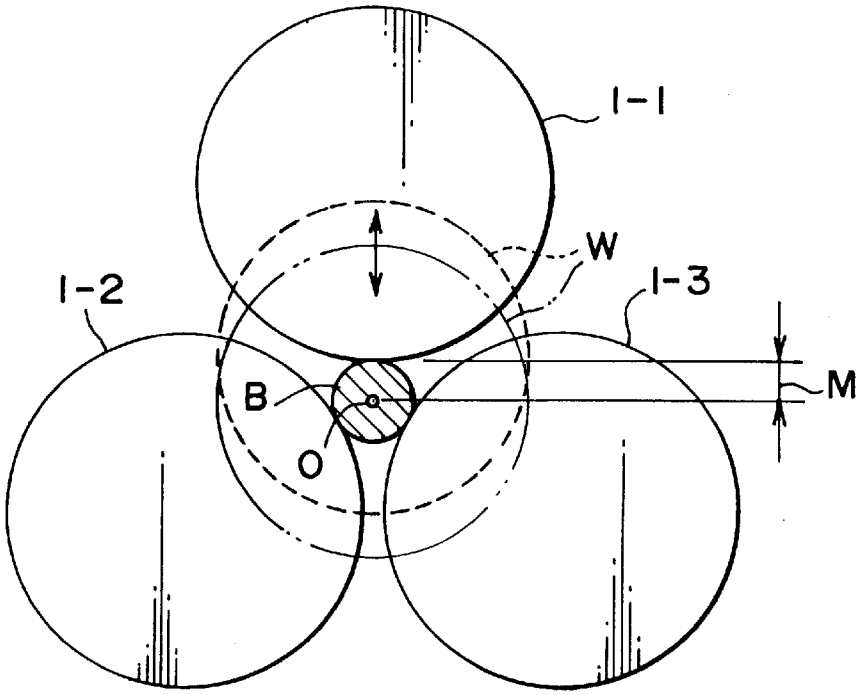
FIG. 5 is a plan view for explaining a position changing direction and shifting distance of a wafer.
Figure 6:
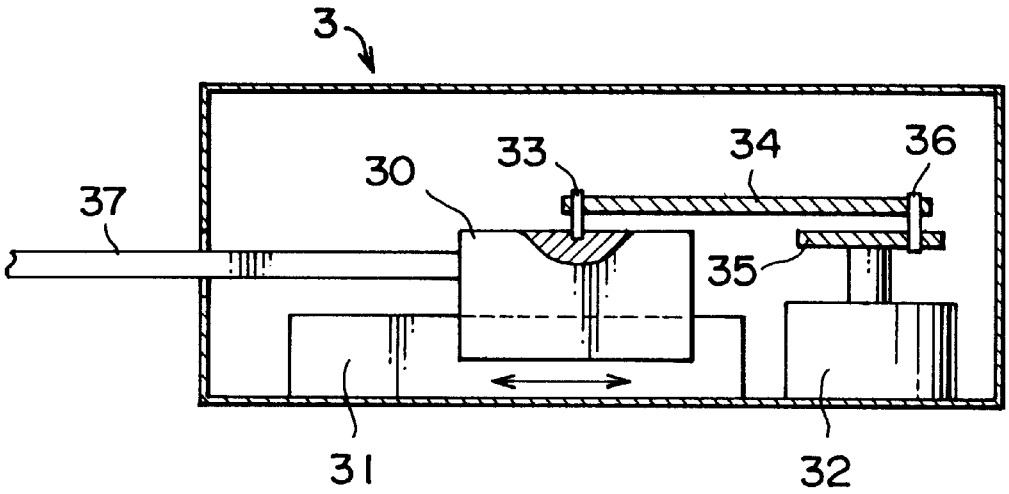
FIG. 6 is a sectional view of a position changing mechanism.

FIG. 5 is a plan view for explaining a rectilinear shifting direction and shifting distance of a wafer; FIG. 6 is a sectional view of the rocking mechanism 3; and FIG. 7 is a plan view of the position changing mechanism 3.

Figure 7:
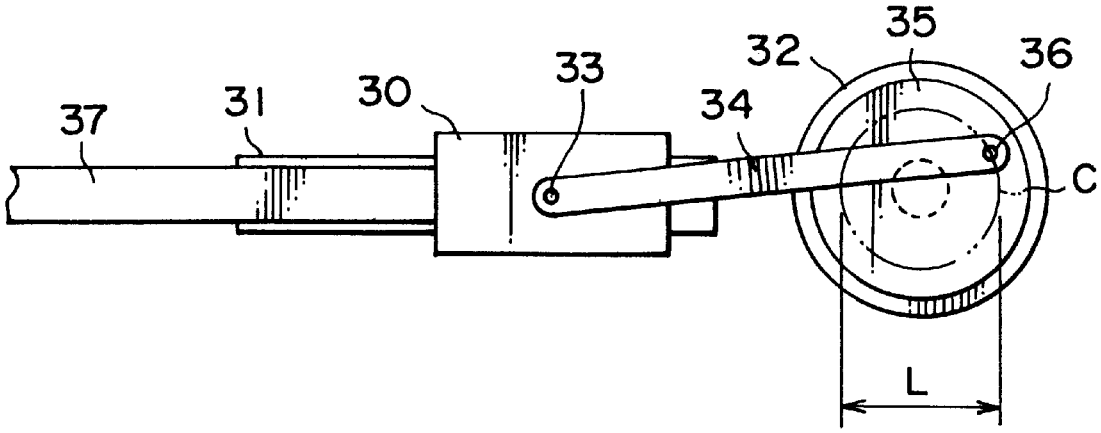
FIG. 7 is a plan view of a rocking mechanism.

As shown in FIG. 6 and FIG. 7, the position changing mechanism 3 is provided with a slider 30 which can move back and forth on a rail 31 and a motor 32 for making the slider 30 move back and forth.

Specifically, the right end of a rod 34 is rotatably connected to a pin 33 provided on the top surface of the slider 30. A disk 35 is attached to the shaft of the motor 32. The left end of the rod 34 is rotatably connected to a pin 36 provided on the disk 35.

Due to this, when the motor 32 is actuated and the disk 35 is made to rotate, the pin 36 rotates on a circle C shown by the two-dot chain line of FIG. 7 and as a result the slider 30 moves back and forth along a distance equal to the diameter L of the circle C.

A support member 37 is affixed to the slider 30 moving back and forth in this way. Due to the support member 37, the support 29 in which the carrier 2, the cylinder 20, and the motor 21 are assembled is supported.

Due to this, by operating the position changing mechanism 3, the carrier head 2 and the wafer W shift along the distance L along with the support 29.

Here, a detailed explanation will be given of the shifting direction and shifting distance of the wafer W due to the position changing mechanism 3.

As shown by the two-dot chain line in FIG. 5, in the state where the wafer W is not allowed to rock, the center of the wafer W and the center point O of the platens 1-1 to 1-3 substantially match, so even if the wafer W is polished while being rotated in this state, as shown by the hatching, the portion B of the wafer W not contacting the platens 1-1 to 1-3 will not be polished.

Accordingly, by making the wafer W shift so that the non-contact portion B contacts any one of the platens 1-1 to 1-3, it is possible to eliminate the non-contact portion B.

Depending on the shifting direction and shifting distance of the wafer W, however, the stability of the wafer W may be impaired and power may be wastefully consumed.

The present inventor took note of this point and in this embodiment decided to make the wafer W (shown by the broken line) shift in the diametrical direction of the platen 1-1 for exactly the distance M of about the radius of the outer periphery of the non-contact portion B, that is, the inside inscribed circle of the platens 1-1 to 1-3.

Due to this, since the wafer W moves in the diametrical direction of the platen 1-1, the wafer W is stably supported by the three platens 1-1 to 1-3.

Further, the position changing mechanism 3 can eliminate the no n-contact portion B just by shifting the assembly comprised of the carrier head 2, the cylinder 20, and the motor 21 for the minimum distance M, so it is possible to keep the power consumption of the shifting mechanism 3 low and reduce the cost by that amount. Accordingly, in this embodiment, the drive distance L of the slider 30 is set to the above distance M.

If it were possible to measure the state of polish of the wafer W polished by the platens 1-1 to 1-3 in this way, it would be possible to achieve a high precision polishing of the wafer W, and this is preferred.

Therefore, in this embodiment, the measuring device 4 is provided.

Figure 8:
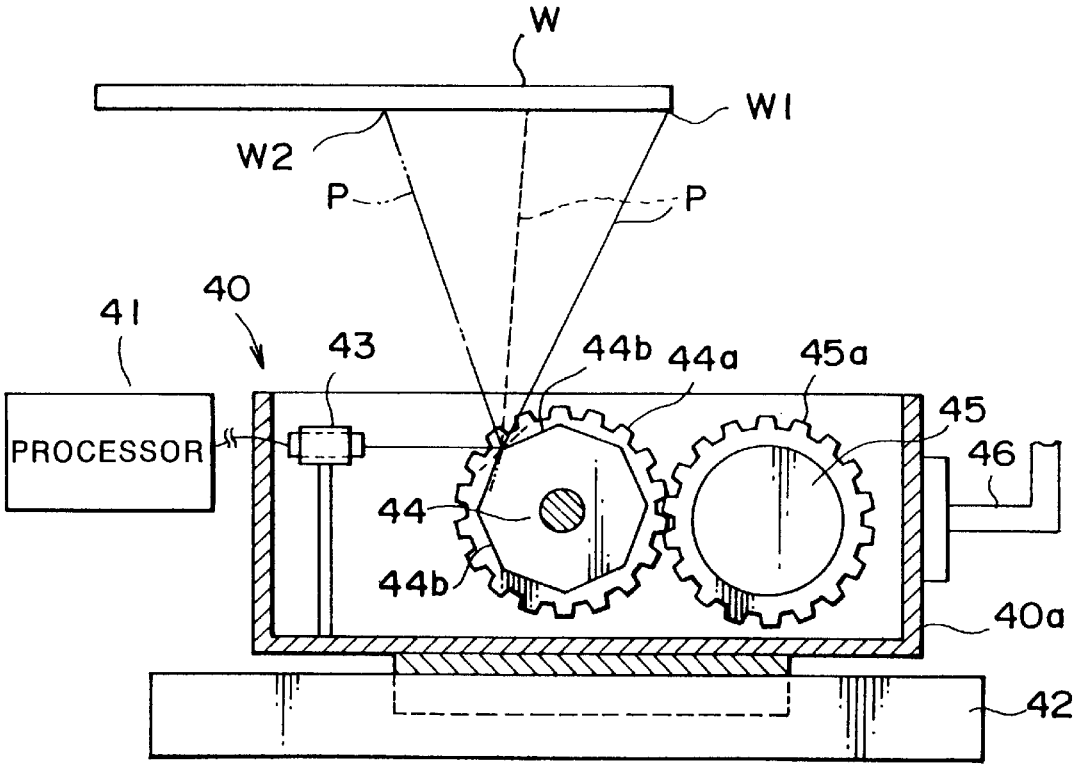
FIG. 8 is a sectional view of the structure of a measuring device.
Figure 9:
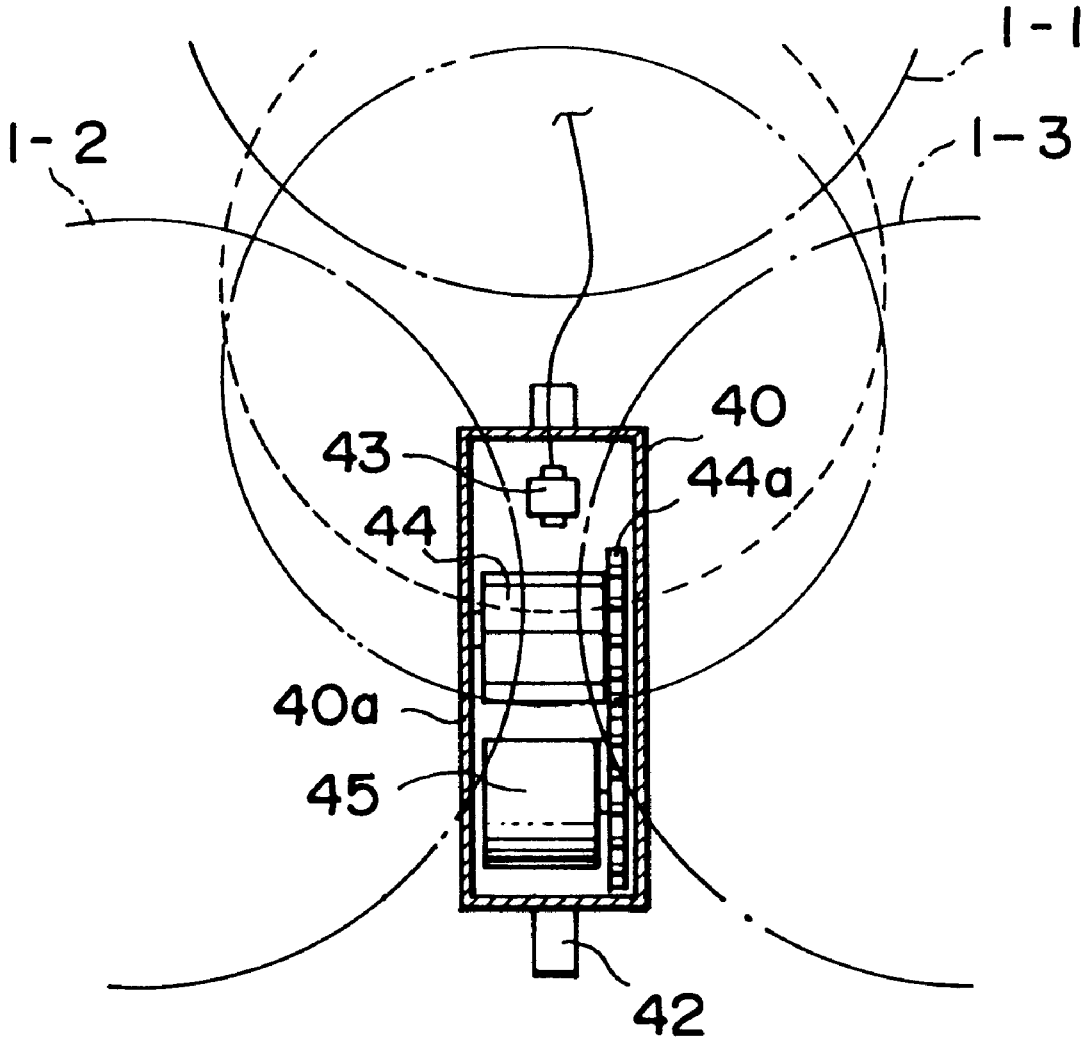
FIG. 9 is a sectional view of the state of arrangement of the measuring device.

FIG. 8 is a sectional view of the structure of the measuring device 4; while FIG. 9 is a sectional view of the state of arrangement of the measuring device 4.

As shown in FIG. 8, the measuring device 4 is comprised of a film thickness measuring device 40 and a processor 41.

The film thickness measuring device 40, as shown in FIG. 9, is slidably attached to a rail 42 affixed facing the platen 1-1 side directly under the clearance between the platens 1-2 and 1-3 shown by the two-dot chain line.

The film thickness measuring device 40 is a device which emits a laser beam on to the polished surface of the wafer W from below, detects the thickness of the oxide film, and outputs that value to the processor 41. As shown in FIG. 8, it is constructed by a laser sensor 43 and polygon mirror 44 assembled in a housing 40*a* which can slide along the rail 42.

Specifically, as shown by this FIG. 8 and FIG. 9, the polygon mirror 44 is rotatably attached between the two side walls of the housing 40*a*. A gear 44*a* is affixed at one end surface of the housing 40*a*. Further, a motor 45 is affixed near the polygon mirror 44. A gear 45*a* attached to its shaft is engaged with the gear 44*a*.

Further, the laser sensor 43 is affixed to the housing 40*a* in a state facing the mirror surface 44*b* of the polygon mirror 44. The laser sensor 43 emits a laser beam P to the mirror surface 44*b* and receives a laser beam P reflected back from the mirror surface 44*b* to detect the thickness of the oxide film of the wafer W.

The film thickness measuring device 40 of this structure is connected through an arm 46 to the support 37 of the position changing mechanism 3 and is designed to shift in synchronization with the wafer W.

The processor 41 is a device which calculates the flatness and uniformity of the polished surface of the wafer W based on the signal of the value of the film thickness output from the film thickness measuring device 40.

Due to this configuration, when the motor 45 of the film thickness measuring device 40 is operated, the polygon mirror 44 rotates due to the engagement of the gears 45*a* and 44*a*. Therefore, the laser beam P emitted from the laser sensor 43 scans from the peripheral rim W1 side to the center W2 side of the wafer W due to the change of the angle of inclination of the mirror surface 44*b*. At this time, since the film thickness measuring device 40 shift in synchronization with the wafer W, the laser beam P reliably scans from the peripheral rim W1 to the center W2 and the signal showing the value of the film thickness is continuously output in time sequence to the processor 41. Further, the flatness and the uniformity of the lower surface of the wafer W as a whole are calculated by the processor 41, so an operator can determine the state of polish from the peripheral rim W1 to the center W2 of the wafer W from the results of the processing continuously in time sequence.

Next, an explanation will be made of the operation of the CMP apparatus of this embodiment.

First, in FIG. 2, if the carrier head 2 holding the wafer W is made to descend by the cylinder 20 in the state with the motors 17 to 19 operating and the platens 1-1 to 1-3 rotating in the same direction, the center of the wafer W and the center point O of the platens 1-1 to 1-3 will substantially match and the wafer W will be positioned in a stable state on the platens 1-1 to 1-3.

In this state, if the carrier head 2 is made to rotate in the reverse direction to the platens 1-1 to 1-3 while pressing the wafer W against the top of the polishing pads 1*a* of the rotating platens 1-1 to 1-3, the oxide film on the bottom surface of the wafer W will be polished by the polishing pad 1*a*.

In this state, however, as shown in FIG. 5, a no n-contact portion B occurs in the wafer W and the entire surface of the wafer W is not polished.

Therefore, if the position changing mechanism 3 is driven, as shown by the broken line, the wafer W will shift in the radial direction of the platen 1-1 by exactly a distance M substantially equal to the radius of the non-contact portion B, the entire bottom surface of the rotating wafer W will contact to the platens 1-1 to 1-3, and the entire bottom surface of the wafer W will be polished by the polishing pads 1*a* of the platens 1-1 to 1-3.

Figure 10:
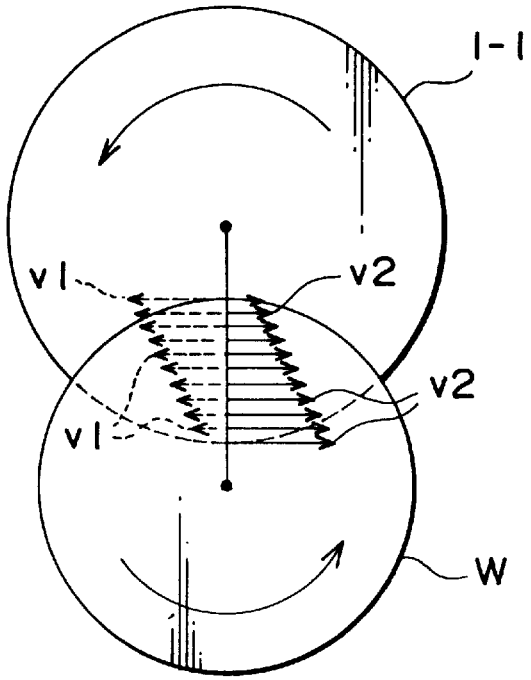
FIG. 10 is a plan view for explaining the relative speed of a contact portion of the wafer.
Figure 11:
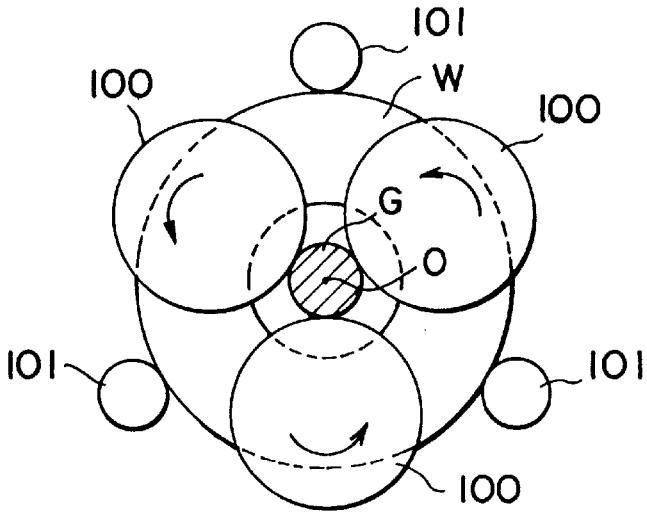
FIG. 11 PRIOR ART
FIG. 11 is a plan view of a polishing apparatus of the related art.
Figure 12:
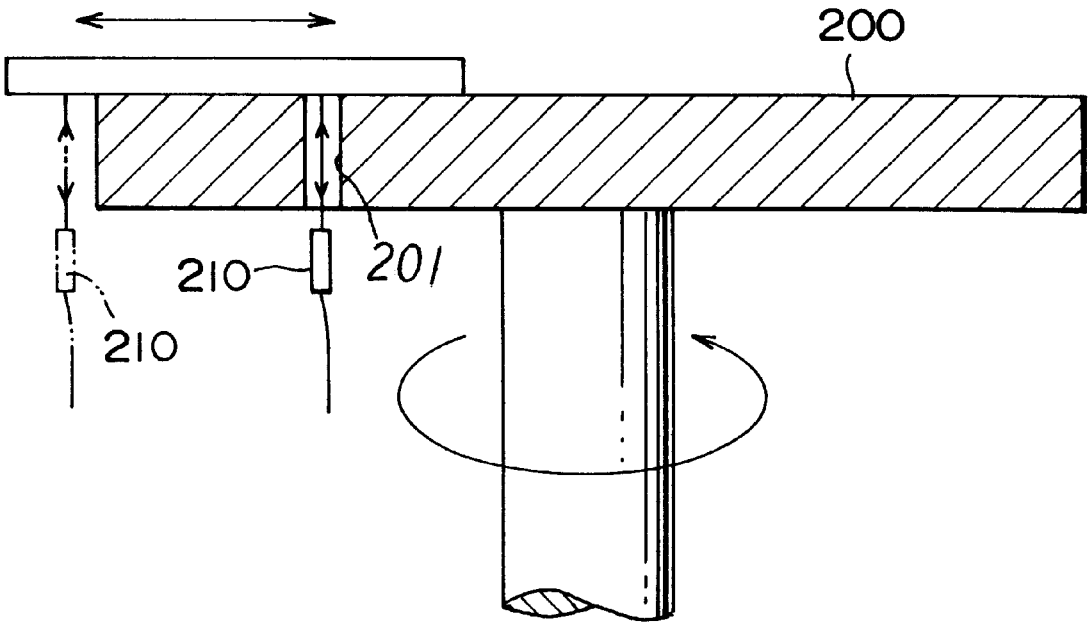
FIG. 12 PRIOR ART
FIG. 12 is a sectional view of a technique for measuring the state of polish of a wafer of the related art.

Since the peripheral velocity of a rotating disk is proportional to the distance from the center, as shown in FIG. 10, the distribution of the peripheral velocity vl at the portion of the wafer W contacting the platen 1-1 becomes as shown by the broken line, while the distribution of the peripheral velocity v2 in the portion contacting the platen 1-1 becomes as shown by the solid line.

Further, since the wafer W and the platen 1-1 are rotating in opposite directions, the relative velocity at each portion of the wafer W contributing to the polishing of the wafer W becomes v1−(−v2)=v1+v2.

Accordingly, so long as the difference between the rotational speed of the wafer W and the rotational speed of the platen 1-1 does not become abnormally large, the relative velocities v1+v2 at all portions of the wafer W become substantially equal and the bottom surface of the wafer W is polished substantially uniformly by the polishing pad 1*a* of the platen 1-1.

The same is true for polishing by the polishing pads 1*a* of the platens 1-2 and 1-3.

This state of polish of the wafer W is measured by the measuring device 4.

That is, as shown in FIG. 8, the peripheral rim W1 to the center W2 of the rotating wafer W is scanned by the laser sensor 43 of the film thickness measuring device 40, the value of the film thickness of the wafer W as a whole is output to the processor 41 continuously and in time sequence, and the flatness and uniformity of the wafer W as a whole are calculated.

Accordingly, when an operator judges from the results of measurement of the measuring device 40 that the polishing rate of the center portion of the wafer W is low, he can increase the pressure of the air being supplied from the air pump 9 through the air hose 90 to the pressure chamber S1 of the carrier head 2 to make the polishing rate of the wafer W as a whole equal and thereby improve the flatness. Further, when the uniformity of polish is poor, he can change the rotational speeds of the motors 17 to 19 or the motor 21 to improve the uniformity of polish of the wafer W. Further, he can monitor the state of measurement of the measuring device 4 and stop the apparatus when the value of the film thickness of the wafer W becomes optimal.

In this way, according to the CMP apparatus of this embodiment, since it is possible to polish the entire surface of the wafer W, it is possible to polish not only a wafer W of a donut shape, but also a disk-shaped wafer W. Further, since it is possible to determine the state of polish of the wafer W continuously and in time sequence by the measuring device 4, it is possible to stop the apparatus when the oxide film of the wafer W reaches the optimal value of film thickness and as a result high precision polishing becomes possible without situations such as excessive polishing or insufficient polishing of the wafer W occurring.

A dressing method using the apparatus of this embodiment will be explained in brief below.

When the platens 1-1 to 1-3 are used for long periods, the polishing pads 1*a* become unevenly worn and become unusable.

In this case, it is necessary to dress the polishing pads 1*a*.

If the CMP apparatus is stopped to dress the polishing pads 1*a*, however, the operating rate of the CMP apparatus will remarkably fall.

Therefore, another apparatus having a ring-shaped or disk-shaped dresser attached to the piston rod 20*d* instead of the carrier head 2 and having the platens 1-1 to 1-3 removed from the shafts 11 to 13 is prepared.

By dressing the polishing pads 1*a* of the platens 1-1 to 1-3 by this apparatus in advance, therefore, it is possible to quickly exchange the platens 1-1 to 1-3 when the polishing pads 1*a* of the platens 1-1 to 1-3 of the CMP apparatus have to be dressed.

Due to this, the time during which the CMP apparatus is stopped becomes just the time for exchange of the platens 1-1 to 1-3 and the operating rate of the CMP can be remarkably improved.

Note that the present invention is not limited to the above embodiments. Various modifications and changes are possible within the gist of the invention.

For example, in the above embodiments, the explanation was given of an apparatus using three platens 1-1 to 1-3, but the invention does not exclude apparatuses using two platens or apparatuses using four or more platens.

Further, in the above embodiments, the platens 1-1 to 1-3 were configured to be rotated independently by the motors 17 to 19, but it is also possible to use a gear mechanism and make the three platens 1-1 to 1-3 rotate integrally in the same direction by a single motor.

In the above embodiment, a laser sensor 43 emitting a laser beam as a light beam was used, but the invention is not limited to this. It is also possible to use various known sensors such as a sensor which emits incandescent light to the wafer W to measure the thickness of the oxide film of the wafer W.

Further, in the measuring device 4 of the above embodiment, a polygon mirror 44 was used to make the laser beam P scan the surface, but it is also possible to adopt all other configurations for making the laser beam P scan the radial direction of the wafer W such as facing the laser sensor 43 upward and rocking it in the radial direction of the wafer W or making the laser sensor 43 pivot back and forth for the scanning.

As explained above in detail, according to the present invention, it is possible to process the entire surface of a workpiece due to the action of the position changing mechanism, so it is possible to uniformly process not only workpieces of a donut shape, but also disk and other shaped workpieces.

Further, according to a preferred embodiment of present invention, it is possible to make a workpiece stably contact a plurality of platens and possible to process the entire surface by a short distance of movement of the workpiece.

Further, according to another preferred embodiment of the present invention and its embodiment, by making the number of the platens three, it is not only possible to save on costs, but also possible to improve the stability of contact of the workpieces.

Further, according to a still another preferred embodiment of the present invention and its embodiments, it is possible to apply this workpiece surface processing apparatus to a polishing apparatus, lapping apparatus, or dressing apparatus.

Further, according to still another preferred embodiment of the present invention and its embodiments, it is possible to uniformly process the entire surface of the wafer.

Further, according to still another preferred embodiment of the present invention and its embodiments, it is possible to measure the entire processed surface of the workpiece continuously, so it is possible to detect the optimal amount of processing and as a result possible to prevent the occurrence of situations such as excessive polishing or insufficient polishing of the workpiece and possible to achieve high precision workpiece processing.

What is claimed is:

1. A workpiece surface processing apparatus comprising:

a plurality of platens arranged substantially point symmetrically and capable of rotating about their centers;

a pressing member for making a workpiece surface contact said plurality of platens and making the workpiece rotate while being pressed; and, a shifting mechanism for making said pressing member change position, wherein said pressing member is one which makes said workpiece contact said plurality of platens so that a center of said workpiece substantially matches with a center of said plurality of platens, and said shifting mechanism makes said pressing member change position such that said workpiece moves in a diametrical direction of one platen by exactly a distance of a radius of an inside inscribed circle of said plurality of platens.

2. A workpiece surface polishing apparatus as set forth in claim 1, wherein three platens are provided.

3. A workpiece surface polishing apparatus as set forth in claim 1, wherein the platens are the platens selected from the group consisting of grinding platens, lapping platens and polishing platens.

4. A workpiece surface polishing apparatus as set forth in claim 1, wherein the workpiece is a wafer.

5. A workpiece surface polishing apparatus as set forth in claim 1, further comprising a measuring device for making a light beam scan a workpiece surface after processing from at least a center to the peripheral rim of the workpiece and measuring the state of processing of a processed surface as a whole.

* * * * *